United States Patent [19]

Mims

[11] Patent Number: 4,699,678

[45] Date of Patent: Oct. 13, 1987

[54] FABRIC CUTTING DEVICE

[76] Inventor: Bruce L. Mims, P.O. Box 153, Green Farms, Conn. 06436

[21] Appl. No.: 888,871

[22] Filed: Jul. 24, 1986

[51] Int. Cl.[4] ..... D06C 25/00

[52] U.S. Cl. ..... 156/88; 156/515; 156/251; 83/171

[58] Field of Search ..... 156/515, 88, 251; 83/171

[56] References Cited

U.S. PATENT DOCUMENTS

| | | | |
|---|---|---|---|
| 2,535,029 | 12/1950 | Atanasoff et al. | 156/515 X |
| 2,805,700 | 9/1957 | Klasing et al. | 156/515 |
| 3,660,205 | 5/1972 | Taylor | 156/515 |
| 4,259,134 | 3/1981 | Joice et al. | 156/515 X |
| 4,352,703 | 10/1982 | Perron | 156/515 X |

*Primary Examiner*—Donald R. Schran

*Attorney, Agent, or Firm*—Edward R. Hyde

[57] ABSTRACT

A device for servicing fabric that is composed primarily of man made fibers such as polyester. The device includes a heated cutting element and two channels that smooth and form the melted edges of the fabric to a desired contour and thickness.

7 Claims, 8 Drawing Figures

FABRIC CUTTING DEVICE

BACKGROUND OF THE INVENTION

The present invention relates to a device for cutting fabric made partially or wholly of man made fibres such as polyester or nylon and sealing the resulting cut edge in good appearance and consistent thickness.

In the textile field natural fibres such as cotton and wool are interwoven with man-made fibres such as polyester and nylon. Sometimes man-made fibres are used exclusively in forming the fabric. In either case as the fabric is being woven on looms it is desirable to trim and seal the edges to prevent raveling and to provide a strong selvedge for subsequent operations in the manufacture of the fabric. In some cases one or more cuts may be made down the length of the fabric as it is being woven and it is useful to seal both of the edges of each cut.

Several methods of accomplishing these objectives are in use; one, the hot-wire method, cuts the fabric with a heated fine-wire, forming a bead on the edges as the melting progresses. Another method is to tuck the edge and weave it again to the main body of the fabric. A further method is to impact the material with an ultrasonically vibrating tool.

Each method has disadvantages. The hot-wire method forms an undesirably thick bead on the edge and results in a crude visual finish. The "tucker" gives a better appearance, but substantially increases the thickness of the fabric at the edge, so that when great lengths of the fabric are reeled up the resulting roll which should be cylindrical is instead "canoe-shaped". The ultrasonic method requires equipment that is inherently expensive.

A need exists for a device which can inexpensively produce a high-quality cut and sealed edge as fabric is being woven on a loom.

It is an object of the present invention to provide a device for cutting and sealing a fabric with a resulting edge seal of good appearance and of a consistent thickness little more than the thickness of the fabric.

Another object of the invention is to provide an improved device having a heated cutting device to sever fabric by a cutting-melting operation.

A still further object of the present invention is to provide a heated cutting tool to sever fabric and control the thickness and shape of the severed fabric edge.

These and other objects of the invention will become apparent from the following detailed description thereof taken with the drawings.

DETAILED DESCRIPTION

Figure 1:
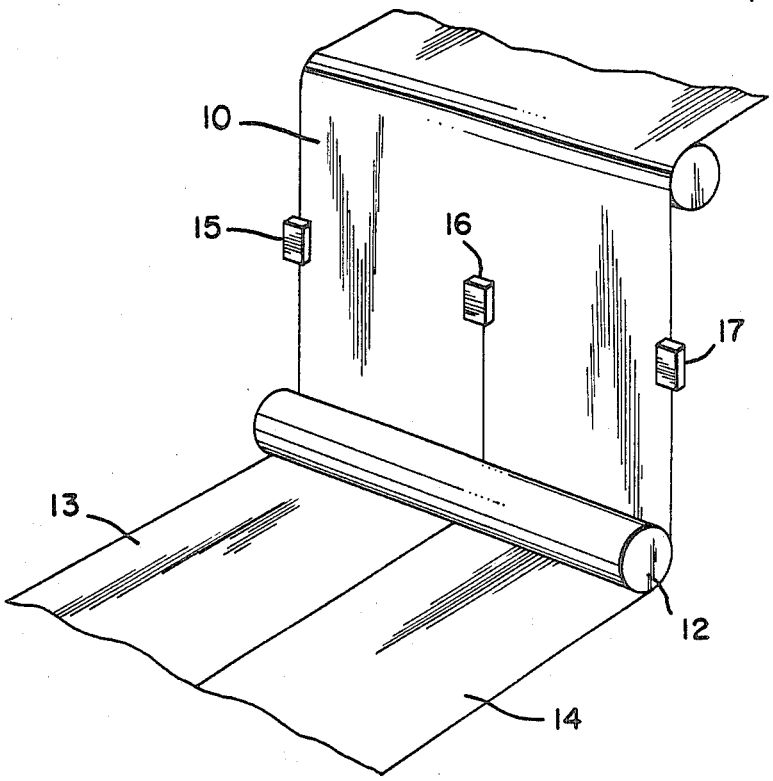
FIG. 1 is a perspective of a portion of a loom having three cutting heads of the present invention.

Referring now to FIG. 1 there is shown a length of fabric 10 passing through a loom having rollers 11 and 12 to direct the fabric. The fibres of the fabric may be wholly or partially man made such as polyester. Synthetic fibers of the type included in the fabric will melt when subjected to heat. The fabric that is severed by the present invention will comprise 70% or more of these man made meltable fibers. It is desirable to have lengths of fabric of predetermined width less than the width of the fabric as it comes from the loom. In the example of FIG. 1 the fabric 10 is severed into strips 13 and 14 of predetermined width. The severing is accomplished by three cutting heads 15, 16 and 17 located at predetermined lateral distances and mounted in any suitable manner to engage the fabric. As shown, cutting head 15 is mounted to sever one outer edge and cutter head 17 the other edge whereas cutter head 16 is centered to divide the fabric 10 into the two strips 13 and 14.

Figure 3:
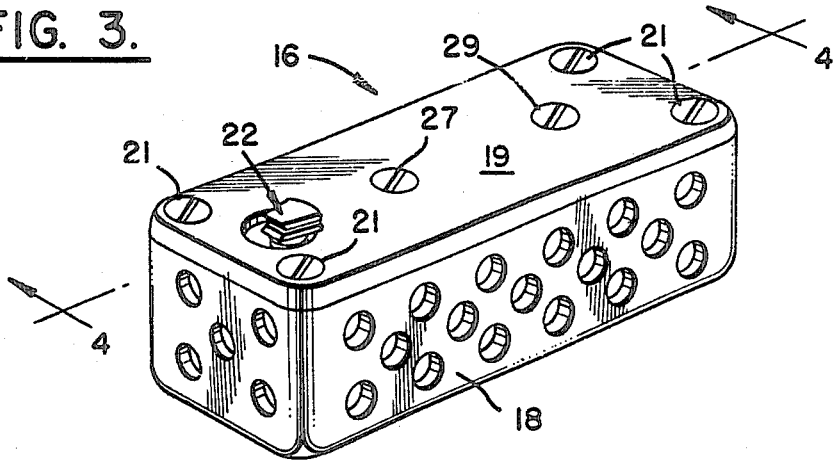
FIG. 3 is a perspective view of a cutting and sealing head with the fabric guide removed.
Figure 4:
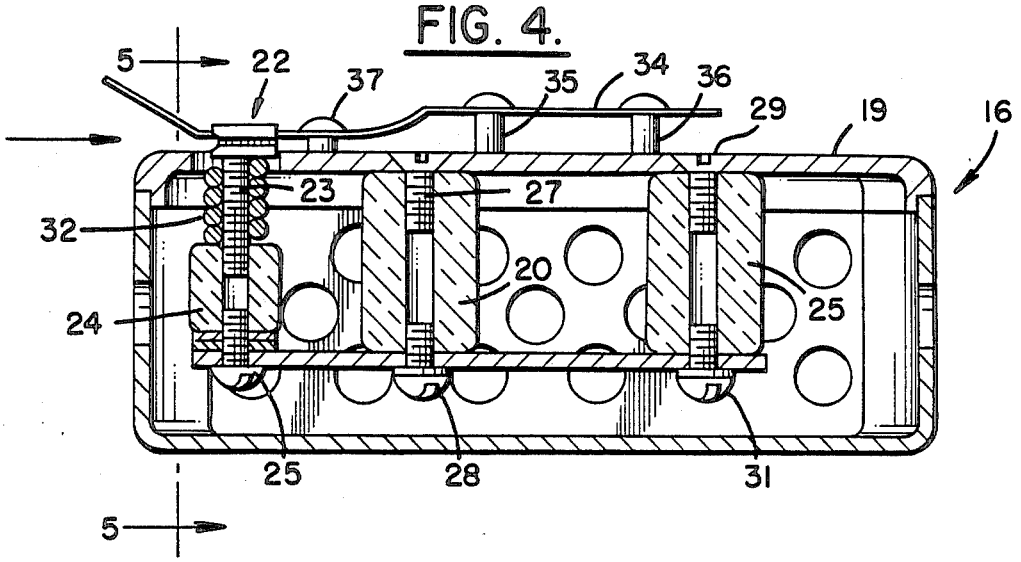
FIG. 4 is a cross section of the head of FIG. 3.
Figure 5:
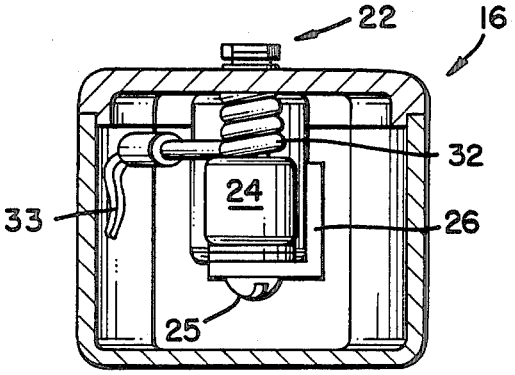
FIG. 5 is a cross section taken on the line 5—5 of FIG. 4.

Each of the three cutting heads are of similar construction and shown in detail in FIGS. 3, 4 and 5. The head comprises a casing made of a unitary bottom and sides piece 18 and top 19 secured to 18 by screws 21.

The cutting tool 22 is secured to a shank 23 by any suitable means which in turn is screw threaded into standoff 24 which is made of a low thermal conductive material such as ceramic. Another screw 25 passes through a cross plate 26 and serves as a mounting screw for the cutting tool assembly 22, 23 and 24. The cross plate is mounted to the underside of head top 19 by standoffs 20, 25 and their mounting screws 27, 28, 29 and 31. Standoffs 20, 25 are made of the same low thermal conductive material as standoff 24.

A resistance heater coil 32 surrounds shank 23 and serves to heat the cutting tool 22. A pair of leads 33 connected to the heater coil 32 lead to a suitable electrical control circuit that supplies electrical energy by conventional means.

Shoe 34 is separated slightly from case top 27, typically by about twice the thickness of the fabric to be cut and sealed. Spacers 35, 36 separate the shoe from the case and by means of screw 37 the distance between the case and shoe may be adjusted. The spacers 35, 36 and screw 37 are downstream of the cutting tool 22 so that the fabric is cut and parted before reaching the spacers and screw. In this manner it passes on both sides of these elements which consequently do not interfere with the fabric flow.

Figure 6:
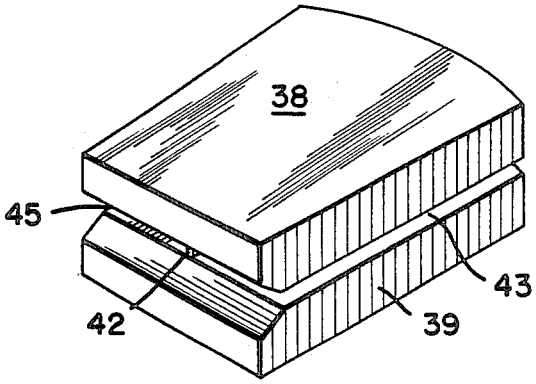
FIG. 6 is a perspective of the cutting tool.
Figure 7:
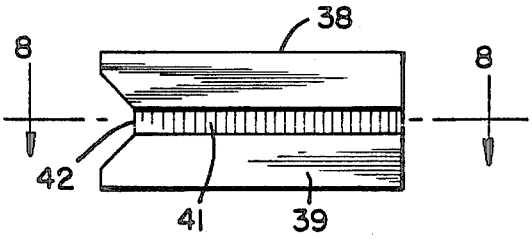
FIG. 7 is a side view of the cutting tool of FIG. 6.
Figure 8:
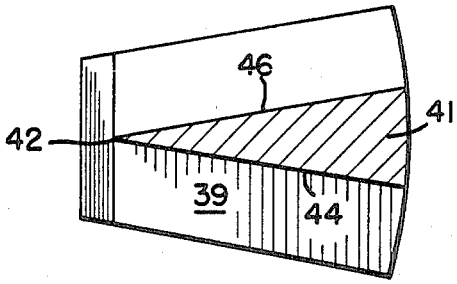
FIG. 8 is a cross section taken on the line 8—8 of FIG. 7.

The details of the cutting tool are more clearly shown in FIGS. 6, 7 and 8. It consists of two plate members 38, 39 each having a substantially flat inner surface, the two inner surfaces facing each other and separated a predetermined distance. The plate members are held apart by wedge 41 having a cutting edge 42 which serves to sever the fabric.

An important feature of the invention is the channel on each side of the wedge 41 through which the severed fabric edge passes to control, limit and smooth out each edge of the fabric.

One channel is designated 43 and is defined by the two inner flat surfaces of members 38, 39 and the side 44 of wedge 41. The other channel 45 is defined by the flat surfaces of members 38, 39 and the other side 46 of the wedge.

It is understood that as the fabric is severed by heated edge 42, the two severed edges are pulled into the two channels. As the fabric is cut, surface tension causes the edges to begin to bead, but because it is forced into the channels the undesirable beading is prevented and the fabric is shaped and smoothed by the channels.

Figure 2:
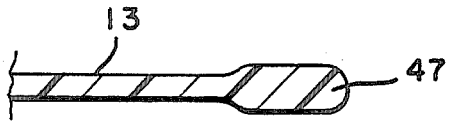
FIG. 2 is a cross section of the edge of a piece of fabric cut and sealed by the present invention.

FIG. 2 shows the fabric 13 with a smooth and shaped edge 47. It is understood that the fabric edge is in a melted state as it passes cutting edge 42 and is promptly directed into channels 43, 45. The channel thickness is chosen to prevent a bead from naturally forming on the severed edge of the fabric as it would in the absence of the channel. The channel will serve to form the melted severed edge as shown at 47 in FIG. 2. The relative speed of the moving fabric and length of the channel is such that as the fabric exits from the rear of the channel the fabric edge is sufficiently solidified that it will retain its form.

The thickness of one size of fabric severed by the present invention is 0.016 inches and the channel spacing is 0.020 inches. As a result the formed edge has a thickness only 0.004 inches thicker than the fabric.

Although the invention has been described with respect to a specific embodiment thereof, it is understood that various embodiments and modifications may be made within the spirit and scope of the appended claims.

I claim:

1. A fabric cutting tool for severing meltable fabric as the fabric traverses a predetermined path comprising:

a pair of plate means spaced apart a predetermined distance greater then the thickness of the fabric;

means to mount said plate means adjacent the path of travel of the fabric to permit the fabric to pass between the pair of spaced apart plate means;

fabric cutting means adapted to be mounted in the path of travel of the fabric between the pair of plate means in respect to the direction of travel of the fabric;

heating means connected to the cutting means to heat the cutting means whereby the moving fabric contacting the cutting means will be severed and the severed edges melted prior to passing between the pair of spaced apart plates.

2. The fabric cutting tool set forth in claim 1 in which said cutting means is a wedge shaped member located between the spaced apart plate means;

said wedge shaped member having two outer edges whereby each edge and the pair of plate means form a channel on each side of the cutting means to receive the two severed edges of the fabric.

3. The fabric cutting tool set forth in claim 2 in which the two channels formed by the pair of plate means and two outer edges of the wedge member positioned to form the severed, melted fabric edges.

4. The fabric cutting tool set forth in claim 3 further including an enclosed tool head to mount the cutting tool.

5. The apparatus set forth in claim 4 including:

shoe means mounted on said tool head adjacent the cutting tool adapted to direct moving fabric to said cutting tool.

6. A fabric cutting and sealing head of the character described comprising an enclosed body member having an opening in an outer face thereof, a cutting and sealing tool mounted to said body member to extend beyond said outer face;

mounting means for said tool extending through said opening into said body member, said tool comprising two side members faving flat surfaces spaced apart a predetermined distance;

a wedge shaped cutting element located between said spaced apart side members, said cutting element having a cutting edge extending perpendicular to said flat surfaces;

electrical means to heat said wedge shaped cutting element whereby moving fabric passing between said side members to contact the cutting edge is severed and the edges of the fabric melted;

the space between said side members forming two channels on either side of said cutting edge to receive the two cut, melted edges of the moving fabric whereby the said fabric edges are prevented from beading and are shaped and smoothed by the channel surfaces.

7. The method of severing and sealing the severed edges of a fabric that includes meltable manmade fibers comprising the steps of:

moving the fabric past a heated cutting edge whereby the fabric is severed and the two resulting edges are in a melted state, forming each fabric edge while in the melted state into a smooth flat contour with a predetermined thickness by combining the edge within a substantially U-shaped channel of constant uniform width, having parallel surface and retaining the fabric edge in the channel for a period of time for it to solidify and exit in a substantially solidified state.

* * * * *